US009463956B2

(12) United States Patent
Lähteenmäki et al.

(10) Patent No.: US 9,463,956 B2
(45) Date of Patent: Oct. 11, 2016

(54) METHOD AND ARRANGEMENT FOR RENEWING THE BRAKING FORCE OF A BRAKE OF A HOISTING MACHINE

(71) Applicants: Jussi Lähteenmäki, Hyvinkaa (FI); Panu Ihalainen, Tervakoski (FI)

(72) Inventors: Jussi Lähteenmäki, Hyvinkaa (FI); Panu Ihalainen, Tervakoski (FI)

(73) Assignee: Kone Corporation, Helsinki (FI)

( * ) Notice: Subject to any disclaimer, the term of this patent is extended or adjusted under 35 U.S.C. 154(b) by 544 days.

(21) Appl. No.: 13/942,008

(22) Filed: Jul. 15, 2013

(65) Prior Publication Data

US 2013/0299281 A1 Nov. 14, 2013

Related U.S. Application Data

(63) Continuation of application No. PCT/FI2012/050062, filed on Jan. 24, 2012.

(30) Foreign Application Priority Data

Feb. 2, 2011 (FI) ..... 20115103

(51) Int. Cl.

| | |
|---|---|
| ***B66B 1/32*** | (2006.01) |
| ***B66B 5/00*** | (2006.01) |
| ***B66D 5/08*** | (2006.01) |
| ***B66D 5/30*** | (2006.01) |

(52) U.S. Cl.

CPC ..... *B66B 5/00* (2013.01); *B66B 5/0037* (2013.01); *B66D 5/08* (2013.01); *B66D 5/30* (2013.01)

(58) Field of Classification Search

CPC ..... B66B 5/00; B66B 5/0037; B66D 5/08; B66D 5/30

USPC ..... 187/247, 277, 278, 288, 290, 305, 306, 187/314, 391–393

See application file for complete search history.

(56) References Cited

U.S. PATENT DOCUMENTS

| | | | | |
|---|---|---|---|---|
| 7,222,698 | B2 * | 5/2007 | Hanninen | G01L 5/288 187/393 |
| 7,527,127 | B2 * | 5/2009 | Osterman | B66B 5/0031 187/288 |
| 7,938,231 | B2 * | 5/2011 | Ueda | B66B 5/02 187/288 |

(Continued)

FOREIGN PATENT DOCUMENTS

| | | |
|---|---|---|
| CN | 1220965 A | 6/1999 |
| CN | 1343620 A | 4/2002 |

(Continued)

OTHER PUBLICATIONS

Finnish Search Report for Finnish Application No. 20115103 dated Oct. 28, 2011.

(Continued)

*Primary Examiner* — Anthony Salata

(74) *Attorney, Agent, or Firm* — Harness, Dickey & Pierce, P.L.C.

(57) ABSTRACT

In a method for renewing a braking force of a hoisting machine, a brake pad of a brake of the hoisting machine is pressed against a braking surface of a rotating part of the hoisting machine, and the braking surface is moved in relation to the brake pad pressed against the braking surface by resisting the friction force between the braking surface and the brake pad.

11 Claims, 3 Drawing Sheets

(56) References Cited

U.S. PATENT DOCUMENTS

| | | | | |
|---|---|---|---|---|
| 8,205,721 | B2 * | 6/2012 | Korhonen | B66B 1/32 187/288 |
| 8,439,168 | B2 * | 5/2013 | Kondo | B66B 1/32 187/288 |
| 8,602,170 | B2 * | 12/2013 | Fischer | B66B 11/043 187/288 |
| 8,746,413 | B2 * | 6/2014 | Schroeder-Brumloop | B66B 5/0093 187/288 |
| 9,061,864 | B2 * | 6/2015 | Spirgi | B66B 5/0037 |
| 2010/0154527 | A1 * | 6/2010 | Illan | B66B 5/0093 73/121 |
| 2014/0311257 | A1 * | 10/2014 | Hubbard | B66B 5/0037 73/862.12 |

FOREIGN PATENT DOCUMENTS

| | | | |
|---|---|---|---|
| CN | 1906111 | A | 1/2007 |
| CN | 101460384 | A | 6/2009 |
| CN | 101734531 | A | 6/2010 |
| EP | 1598302 | A1 | 11/2005 |
| FI | 118684 | B1 | 2/2008 |
| FI | 119877 | B1 | 4/2009 |
| JP | 2006298569 | A | 11/2006 |
| WO | WO-2005/066057 | A2 | 7/2005 |
| WO | WO-2007020325 | A2 | 2/2007 |

OTHER PUBLICATIONS

International Search Report PCT/ISA/210 for PCT/FI2012/050062 dated Apr. 10, 2012.

Written Opinion PCT/ISA/237 for PCT/FI2012/050062 dated Apr. 10, 2012.

Chinese Office Action dated Jan. 21, 2015 issued in corresponding Chinese Application No. 201280007316.2.

* cited by examiner

METHOD AND ARRANGEMENT FOR RENEWING THE BRAKING FORCE OF A BRAKE OF A HOISTING MACHINE

This application is a continuation of PCT International Application No. PCT/FI2012/050062 which has an International filing date of Jan. 24, 2012, and which claims priority to Finnish patent application No. 20115103 filed Feb. 2, 2011, the entire contents of both which are incorporated herein by reference.

FIELD OF THE INVENTION

The invention relates to improving the operating capability of the brakes of hoisting machines.

BACKGROUND OF THE INVENTION

A hoisting machine of an elevator comprises one or more brakes, which lock the hoisting machine in position when the elevator is stopped at a stopping floor. The brake of a hoisting machine can, in terms of its structure, be e.g. a drum brake or a disc brake. When activating a brake, the activation means, such as thruster springs, press the brake pad of the brake of the hoisting machine into contact with the braking surface on a rotating part of the hoisting machine to brake the movement of the rotating part of the hoisting machine. In normal operation of the elevator, the brake/brakes is/are activated after the electric drive has driven the elevator car to a stopping floor and has stopped the movement of the elevator car. When the elevator is stopped the doors of the elevator car as well as the landing doors on the stopping floor are opened, in which case passengers are able to leave the elevator car and also to move into the elevator car.

From the viewpoint of safe operation of an elevator, it is important that the braking force of the brake/brakes of the hoisting machine is sufficient in total to stop movement of the elevator car in different operating situations, even in a situation in which an overload of approx. 25 percent has been loaded into the elevator car and the elevator car is traveling downwards. One problem is that the braking force might gradually weaken e.g. owing to dirt, grease, et cetera, that has got onto the brake pad or onto the braking surface of the hoisting machine.

Publication WO 2007020325 A2 presents a solution to the problem, wherein the operation of the machinery brakes is monitored by activating the brakes sequentially such that initially only the first brake is activated, and the other brakes are activated with a delay. The operating condition of the first brake is monitored by measuring the movement status of the elevator in a situation in which only the first brake is activated. If it is detected that the operating condition of one or more brakes has deteriorated, the elevator is switched to drive prevention mode. The solution therefore enables regular and automatic monitoring of the operating condition of the brakes.

Although the aforementioned solution does improve the monitoring of the operating condition of the brakes, and thereby promotes the safety of the elevator system, from the viewpoint of elevator service a requirement concerning continuity of the operation of the elevator is also attached to the operation of the elevator. Consequently, it must be possible to return a brake of diminished operating condition to proper operating condition as quickly as possible, because fault situations if prolonged could impair elevator service. It would also be advantageous to find an improvement for minimizing the amount of fault situations of a brake.

AIM OF THE INVENTION

The aim of the invention is to bring an improvement to the operating reliability of the brake of a hoisting machine by renewing the braking force of the brake of the hoisting machine. To achieve this aim the invention discloses a method according to claim 1, a method according to claim 6, a method according to claim 7, and also an arrangement according to claim 9. The preferred embodiments of the invention are described in the dependent claims. Some inventive embodiments and inventive combinations of the various embodiments are also presented in the descriptive section and in the drawings of the present application.

SUMMARY OF THE INVENTION

In the method according to the invention for renewing the braking force of a brake of a hoisting machine, the brake pad of the brake of the hoisting machine is pressed against the braking surface of a rotating part of the hoisting machine and the braking surface is moved in relation to the brake pad pressed against the braking surface by resisting the friction force between the braking surface and the brake pad.

In a preferred embodiment of the invention a rotating part of the hoisting machine is moved by resisting the friction force between the braking surface and the brake pad pressed against the braking surface.

In a preferred embodiment of the invention the braking surface is moved by driving the hoisting machine. For example, the braking force of the brake/brakes of an elevator can be renewed according to the invention also by activating one or more of the brakes of the hoisting machine during a run with the elevator.

In a preferred embodiment of the invention the minimum length of the movement needed for renewing the braking force of a brake of the hoisting machine is determined and the braking surface is moved in relation to the brake pad at least by the amount of the minimum length of the movement needed for renewing the braking force. The minimum length of the movement needed for renewing the braking force can be proportional to e.g. the material selections and/or surface roughness of the friction surfaces of the brake pad/rotating part of the hoisting machine. The minimum length of the movement needed can be proportional also to, inter alia, the magnitude of the force pressing the brake pad against the braking surface of a rotating part of the hoisting machine.

In a preferred embodiment of the invention the hoisting machine comprises at least two controllable brakes, in which case in the method each of the brakes of the hoisting machine is activated in turn and the other brakes are controlled open at the same time such that of the brakes only one at a time is activated and also a rotating part of the hoisting machine is moved by resisting the friction force between the brake pad of the activated brake and the braking surface.

In the method according to the invention the need for renewing the braking force of a brake of a hoisting machine is determined, and if a need for renewing the braking force is detected, one of the methods disclosed above for renewing the braking force of a brake of a hoisting machine is performed. After this a need for renewing the braking force of a brake of the hoisting machine is again determined, and if a need for renewing the braking force of a brake of the hoisting machine is still detected, the system is switched to drive prevention mode, in which the next run of the hoisting machine is prevented.

The arrangement according to the invention for renewing the braking force of a brake of a hoisting machine comprises brake control means for controlling a brake of the hoisting machine. The arrangement also comprises a drive device for driving the hoisting machine. The arrangement further comprises a control unit, which is configured to form a control command for activating a brake of the hoisting machine. The control unit is further configured to form a control command for driving the hoisting machine by resisting the friction force between the brake pad of the activated brake of the hoisting machine and the braking surface for renewing the braking force of the activated brake of the hoisting machine.

In a preferred embodiment of the invention the hoisting machine comprises at least two controllable brakes, and the brake control means are configured to activate a brake of the hoisting machine and to control the other brakes of the hoisting machine open at the same time such that of the brakes of the hoisting machine only one at a time is activated.

In a preferred embodiment of the invention the control unit is configured to determine the movement of a rotating part of the hoisting machine. In a preferred embodiment of the invention the control unit is configured to compare the movement of a rotating part of the hoisting machine to the minimum length of the movement needed for renewing the braking force of a brake of the hoisting machine, and the control unit is configured to discontinue a run of the hoisting machine after the length of the movement of the rotating part of the hoisting machine has reached the minimum length of the movement needed for renewing the braking force of a brake of the hoisting machine.

In a preferred embodiment of the invention the arrangement comprises determination means for determining the need for renewal of the braking force of one or more brakes of the hoisting machine. In a preferred embodiment of the invention the control unit is configured to form a control command for renewing the braking force of a brake of the hoisting machine on the basis of the need for renewal of the braking force.

The invention enables renewing of the braking force produced by a brake/brakes of a hoisting machine such that the braking force can, at least to some extent, be returned during the lifecycle of the brake. The braking force of a brake of a hoisting machine generally diminishes over time, because the brake/brakes are mainly used only for static braking, in other words the brake/brake is activated only when movement of the rotating part of the hoisting machine has stopped. This results in the friction surfaces between the brake pad and the braking surface of the rotating part of the hoisting machine becoming dirty, when detached substance that diminishes the braking force adheres to the friction surface.

By means of the invention, the servicing visits and unnecessary brake replacements, which are connected to the aforementioned gradual reduction of braking force, otherwise caused by deterioration of the braking force of a brake of a hoisting machine can be reduced. Also design of a brake is facilitated, because when designing the brake it is not necessary to take into account the diminishing friction coefficient/gradual reduction of braking force.

The aforementioned summary, as also the additional features and additional advantages of the invention presented below, will be better understood by the aid of the following description of some embodiments, said description not limiting the scope of application of the invention.

MORE DETAILED DESCRIPTION OF PREFERRED EMBODIMENTS OF THE INVENTION

Figure 1:
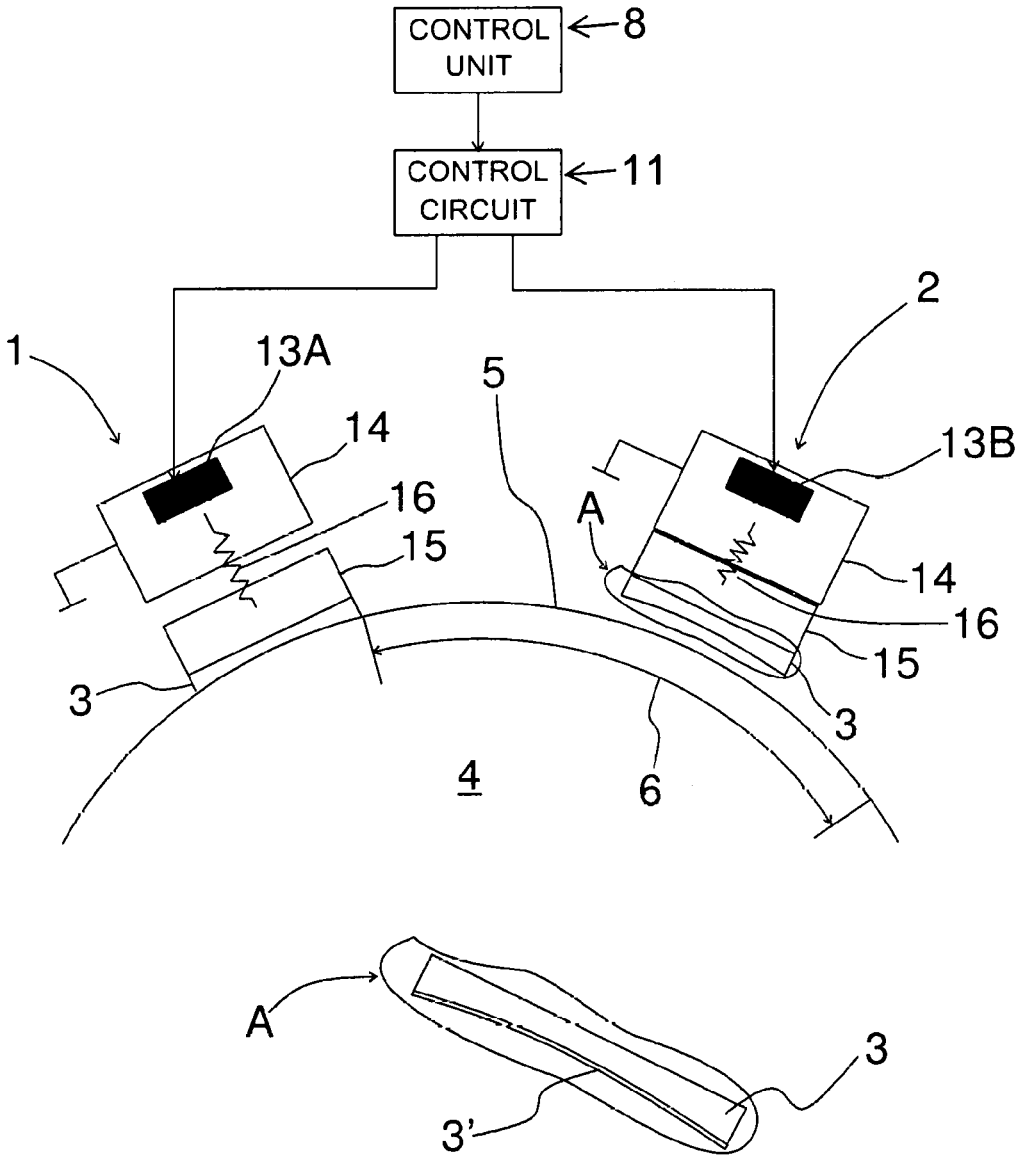
FIG. 1 illustrates one arrangement according to the invention

FIG. 1 illustrates an arrangement according to the invention for renewing the braking force of the brakes 1, 2 of a hoisting machine. The hoisting machine comprises two brakes 1, 2. The brakes 1, 2 comprise a frame part 14, which is attached to the stationary machine frame (not in figure) of the hoisting machine. In addition, the brakes comprise a brake shoe 15, which is movably supported on the frame part 14 of the brake. A brake 1, 2 is activated by pressing the brake pad 3 attached to the brake shoe 15 against the braking surface 5 on a rotating part 4 of the hoisting machine (which is here the brake drum 5 of a drum brake, but which could also be e.g. a brake disc 5 of a disc brake), in which case the friction force between the brake pad 3 and the friction surfaces of the braking surface 5 starts to brake the movement of the rotating part 4 of the hoisting machine. The brakes comprise springs 16 as thrusting means, which springs while supported on the frame part 14 of the brake press the brake pad 3 against the braking surface 5 of the rotating part of the hoisting machine when the brake is activated. The brake is opened by supplying current to the electromagnet 13A, 13B in the frame part 14 of the brake, the magnetic attraction force produced by which electromagnet then pulls the brake pad 3 off the braking surface 5 of the rotating part of the hoisting machine and towards the frame part 14 by resisting the thrusting force produced by the springs 16. In the situation of FIG. 1 the brake 1 is activated and the brake 2 has been controlled open. The structure of the control circuit 11 supplying current to the coil 13 of the electromagnet of the brake in the embodiment of FIG. 1 is described in more detail in FIG. 3.

Figure 3:
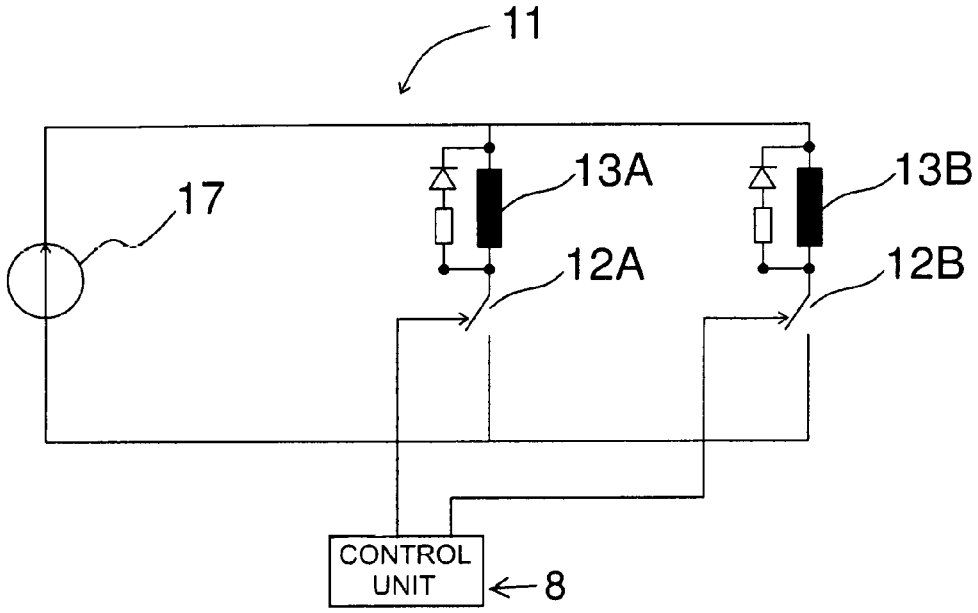
FIG. 3 illustrates one brake control circuit according to the invention

According to FIG. 3, the current supply to the coil 13A, 13B of the electromagnet of each brake 1, 2 occurs from a DC voltage source 17. The DC voltage source 17 can be made e.g. by rectifying AC voltage with a rectifying bridge. The current supply of the coil 13A of the electromagnet of the first brake 1 is controlled with the controllable switch 12A, and the current supply of the coil 13B of the electromagnet of the second brake 2 is controlled with the controllable switch 12B. The controllable switch 12A, 12B can be a mechanical switch, such as a relay; the controllable switch 12A, 12B can also, however, be an electronic switch, such as a MOSFET transistor or an IGBT transistor. The control signal for controlling the switches 12A, 12B is formed with the microprocessor in the control unit 8. The current supply to the coil 13A, 13B of the electromagnet starts by closing the controllable switch 12A, 12B that is in series with the coil 13A, 13B, in which case the brake 1, 2 in question opens. The current supply to the coil 13A, 13B of the electromagnet is disconnected by opening the controllable switch 12A, 12B that is in series with the coil 13A, 13B, in which case the brake 1, 2 in question activates.

The brake pads 3 of the brakes 1, 2 of the hoisting machine are made of composite. The composite contains soft parts, which detach over time. The brakes of the hoisting machine are mainly used only for static braking, in other words the brakes 1, 2 are activated only after movement of the rotating part 4 of the hoisting machine has stopped. Since in static braking the brake pads 3 are pressed fast against a stationary braking surface 5, soft parts detaching from the composite material of the brake pad compact on the surface of the brake pad 3, gradually forming a layer (3', see FIG. 1), which reduces the friction and, at the same time, the braking force.

The control unit 8 determines the need for renewal of the braking force of the brake 1, 2 of the hoisting machine by activating the brakes 1, 2 of the hoisting machine in turn and by controlling one of the brakes 1, 2 open at the same time such that only one of the brakes 1, 2 is activated at a time. After this the control unit 8 sends a control command to the frequency converter, which supplies electric power to the hoisting machine. On the basis of the control command, the frequency converter drives the hoisting machine against the activated brake 1, 2 with a certain testing torque. At the same time the control unit 8 measures the movement of a rotating part 4 of the hoisting machine when driving against the brake 1, 2, and when it detects movement the control unit 8 deduces a need for renewing the braking force of the brake 1, 2. For measuring the movement the control unit comprises an input for the measuring data of a sensor measuring movement; the aforementioned sensor measuring movement can be e.g. an encoder fitted in connection with the rotor of the hoisting machine. On the other hand, movement of the hoisting machine can also be determined from the electrical parameters of the hoisting machine, such as from the current, from the voltage and/or from the source voltage produced by the rotor excitation of the rotating rotor. The need for renewal of the braking force is determined separately for both the brakes 1, 2, and when a need for renewal is detected a procedure is performed, if necessary, for renewing the braking force.

When renewing the braking force the frequency converter drives the hoisting machine by resisting the friction force between the brake pad 3 pressed against the braking surface 5 and the braking surface 5. In this case only the brake 1, 2 of which the braking force is renewed is activated and the other brake 1, 2 is controlled open. A certain minimum length (6, see FIG. 1) is determined for the length of the movement of the rotating part 4 of the hoisting machine, the length of which the braking surface of the hoisting machine must travel so that the layer 3' on the surface of the brake pad 3 of the brake of the hoisting machine, said layer reducing braking force, would be worn off and the braking force would be returned to what it was before. The control unit 8 measures the distance traveled by a rotating part 4 of the hoisting machine when driving against the brake 1, 2, and after the distance traveled has reached the minimum length of movement needed for renewing the braking force, the control unit 8 discontinues the drive against the brake 1, 2. After this the control unit 8 again determines the need for renewal of the braking force of the brake 1, 2 in question, by activating the brake 1, 2 in question, by controlling another of the brakes 1, 2 open at the same time, and also by driving the hoisting machine with testing torque against the activated brake 1, 2, as described above. If the test still indicates a need for renewal of the braking force, in other words the earlier attempt to renew the braking force failed, the software of the microprocessor of the control unit 8 switches to drive prevention mode, in which the next run with the hoisting machine is prevented. In addition, the control unit 8 can send information about the prevention of a drive also to some other control device or monitoring device belonging to the same system.

The procedure for renewing the braking force of a brake 1, 2 can also be repeated a number of times before the activation of drive prevention mode.

In one embodiment of the invention the return of braking force is determined during the renewal procedure, by measuring the speed/acceleration of a rotating part 4 of the hoisting machine when driving against the brake at a constant torque. The gradual return of braking force becomes evident in this case as a gradual deceleration of the movement of the rotating part 4 of the hoisting machine. It must, however, be taken into account that in this case the determination only applies to kinetic friction, so that the friction force/braking force is generally other than when determining the friction force/braking force of the stationary hoisting machine. In addition, it must be take into account that the friction coefficient might change (increase) when the brake pad heats up during braking.

Figure 2:
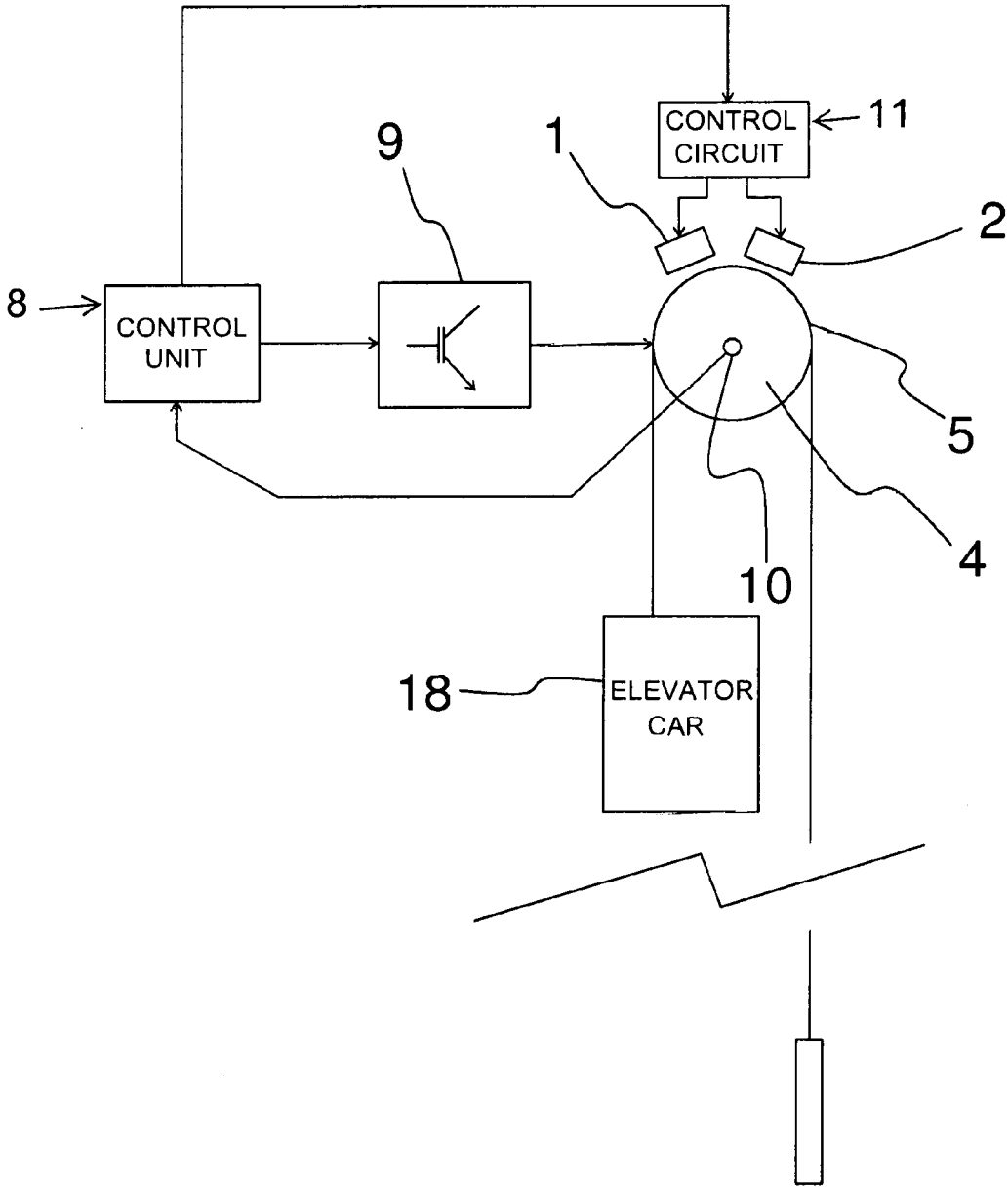
FIG. 2 presents as a block diagram an electric drive of an elevator, into which electric drive an arrangement according to the invention is fitted

FIG. 2 presents an electric drive of an elevator, into which electric drive is fitted an arrangement for renewing the braking force of a hoisting machine, said arrangement having been described in connection with the embodiments of FIGS. 1 and 3. The elevator car 18 and the counterweight are suspended in the elevator hoistway with elevator ropes passing via the traction sheave of the hoisting machine. The elevator car 18 is moved in the elevator hoistway with the hoisting machine, which is driven by supplying electric power to the electric motor of the hoisting machine with a frequency converter 9. The rotation of the rotor of the hoisting machine is measured with an encoder 10. The control unit 8 is connected with control cables to the control circuit 11 of the machinery brakes 1, 2 of the hoisting machine. In addition, the control unit 8 is connected to the frequency converter 9 in a manner allowing data transfer. The control unit 8 also comprises an input for the measuring data of the encoder 10.

The control unit 8 determines the need for renewal of the braking force of the brake 1, 2 of the hoisting machine by activating the brakes 1, 2 in turn and by controlling one of the brakes 1, 2 open at the same time such that only one of the brakes 1, 2 is activated at a time. A force is exerted on a rotating part 4 of the hoisting machine, which force can be produced in the manner described above by driving with the frequency converter against the brake; in addition to, or instead of, this, in forming the force the force difference acting in the elevator ropes on the different sides of the traction sheave of the hoisting machine can also be utilized, which force difference causes, inter alia, weight differences between the elevator car and the counterweight. The control unit 8 measures the movement of the rotating part 4 of the hoisting machine, said part being subjected to the force effect, and when it detects movement the control unit 8 deduces a need for renewing the braking force of the activated brake 1, 2. The need for renewal of the braking force is determined separately in respect of both the brakes 1, 2, and when a need for renewal is detected a procedure is performed, if necessary, for renewing the braking force.

Renewal of the braking force can be implemented as described above by driving the hoisting machine by resisting the friction force between the brake pad 3 pressed against the braking surface 5 and the braking surface 5. In this case, in forming the force effect the force difference acting in the elevator ropes on the different sides of the traction sheave of the hoisting machine can also be utilized.

Renewal of the braking force can also be implemented by activating one or more of the machinery brakes 1, 2 during a run of the elevator such that the braking surface slides against the braking surface 3 when the elevator car is stopping. In this way also the kinetic energy of the elevator car to be stopped can also be utilized in renewing the braking force.

After the renewal procedure of the braking force the control unit 8 again determines the need for renewal of the braking force of the target brake 1, 2 in the manner described above. If the test still indicates a need for renewal of the braking force, in other words the earlier attempt to renew the braking force failed, the software of the microprocessor of the control unit 8 switches to drive prevention mode, in which the next run with the hoisting machine is prevented. In addition, the control unit 8 can send information about the prevention of a drive also to the service center of the elevators, e.g. via a wireless link or data transfer cable. Information about the drive prevention is also presented on the display of the control unit 8. In one embodiment of the invention, deactivation of the drive prevention requires that a serviceman visits the elevator when deactivating the drive prevention using a manual user interface of the control unit 8. At the same time the serviceman can, after receiving the aforementioned drive prevention notification, perform necessary inspection procedures and/or servicing procedures for the machinery brakes 1, 2.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A method for renewing a braking force of a hoisting machine, the method comprising:

activating an activated brake of at least two brakes of the hoisting machine such that the activated brake is pressed against a braking surface of a rotating part of the hoisting machine;

first driving the hoisting machine against the activated brake using a testing torque;

first determining whether the activated brake applies a braking force sufficient to resist a movement of the rotating part when the hoist machine is driven against the activated brake; and renewing the braking force, if the first determining determines that the braking force applied by the activated brake is insufficient, the renewing including, second driving the hoisting machine while continuing to activate the activated brake, second determining if a distance traveled by the rotating part reaches a minimum length to renew the braking force, and discontinuing the second drive against the activated brake, if the distance reaches the minimum length.

2. The method according to claim 1, wherein the first driving and the second driving the hoist machine includes moving the rotating part of the hoisting machine by resisting a friction force between the braking surface and a brake pad of the activated brake pressed against the braking surface.

3. The method according to claim 1, wherein the first driving and the second driving the hoist machine includes moving the braking surface.

4. The method according to claim 1, wherein the minimum length is a length that the braking surface moves in relation to a brake pad of the activated brake such that the length is sufficient to wear off a layer on the surface of the brake pad formed due to one or more of dirt and grease on the surface thereof.

5. The method according to claim 1, wherein the activating the activated brake includes sequentially activating the at least two brakes.

6. The method according to claim 1, further comprising:

switching the hoisting machine to a drive prevention mode, if the renewing of the braking force fails.

7. An arrangement for renewing a braking force of a hoisting machine, comprising:

at least two brakes;

a driving circuit configured to drive the hoisting machine against an activated brake of the at least two brakes; and a processor configured to, activate the activated brake such that the activated brake is pressed against a braking surface of a rotating part of the hoisting machine, send a control signal to the driving circuit to drive the hoisting machine against the activated brake using a testing torque, determine whether the activated brake applies a braking force sufficient to resist a movement of the rotating part when the hoist machine is driven against the activated brake, and renew the braking force, if the braking force applied by the activated brake is insufficient, the renewing including, driving the hoisting machine while continuing to activate the activated brake, determining if a distance traveled by the rotating part reaches a minimum length to renew the braking force, and discontinuing the drive against the activated brake, if the distance reaches the minimum length.

8. The arrangement according to claim 7, wherein the processor is configured to sequentially activate the at least two brakes.

9. The arrangement according to claim 7, wherein the processor is configured to switch the hoisting machine to drive prevention mode, if the processor is unable to renew the braking force.

10. The arrangement according to claim 9, wherein the minimum length is a length that the braking surface moves in relation to a brake pad of the activated brake such that the length is sufficient to wear off a layer on the surface of the brake pad formed due to one or more of dirt and grease on the surface thereof.

11. The arrangement according to claim 10, wherein the processor is configured to send the control signal to renew the braking force, if the movement of the rotating part is determined.

* * * * *